US010030920B2

(12) United States Patent
Chow

(10) Patent No.: US 10,030,920 B2
(45) Date of Patent: Jul. 24, 2018

(54) METHOD OF CLEANING A HEAT EXCHANGER

(71) Applicant: HVS ENGINEERING PTE LTD, Singapore (SG)

(72) Inventor: Alex Kok Heng Chow, Singapore (SG)

(73) Assignee: HVS ENGINEERING PTE LTD, Singapore (SG)

( * ) Notice: Subject to any disclaimer, the term of this patent is extended or adjusted under 35 U.S.C. 154(b) by 0 days.

(21) Appl. No.: 15/029,216

(22) PCT Filed: Oct. 13, 2014

(86) PCT No.: PCT/SG2014/000480

§ 371 (c)(1),
(2) Date: Apr. 13, 2016

(87) PCT Pub. No.: WO2015/057163

PCT Pub. Date: Apr. 23, 2015

(65) Prior Publication Data

US 2016/0238333 A1 Aug. 18, 2016

(30) Foreign Application Priority Data

Oct. 14, 2013 (SG) ..... 2013076799

(51) Int. Cl.
*F28G 1/12* (2006.01)
*B08B 9/04* (2006.01)
(Continued)

(52) U.S. Cl.
CPC ..... *F28G 1/12* (2013.01); *B08B 9/04* (2013.01); *B08B 9/053* (2013.01); *B08B 9/057* (2013.01); *F28D 7/163* (2013.01)

(58) Field of Classification Search
CPC ..... F28G 1/12; B08B 9/055; B08B 9/0323; B08B 9/0551; B08B 9/0557; B08B 9/057; B08B 9/04; B08B 9/053
See application file for complete search history.

(56) References Cited

U.S. PATENT DOCUMENTS 2,539,354 A * 1/1951 Minyard ..... E21B 37/02 15/104.061
2,951,255 A * 9/1960 Ver Nooy ..... B08B 9/0552 118/DIG. 10
(Continued)

FOREIGN PATENT DOCUMENTS

EP 53355 A * 6/1982
EP 0 220 347 A1 5/1987
(Continued)

*Primary Examiner* — Devon Russell
(74) *Attorney, Agent, or Firm* — Seed IP Law Group LLP

(57) ABSTRACT

The invention relates to a method for cleaning a heat exchanger. The heat exchanger comprises a plurality of tubes extending between a first header and a second header, and further comprises an insertion unit for introducing a plurality of projectiles thereinto. A first step of the method comprises pumping a fluid into the first header. A second step comprises inserting the plurality of projectiles into the fluid, such that the plurality of projectiles are distributed within the fluid. A third step comprises flowing the fluid and the projectiles through the tubes, such that the projectiles abrades at least one tube. A fourth step comprises discharging the fluid and the projectiles out of the second header. Among the plurality of projectiles, at least one projectile has a different specific gravity, relative to the fluid, from at least one of the remaining projectiles.

8 Claims, 8 Drawing Sheets

(51) Int. Cl.

| | |
|---|---|
| ***B08B 9/057*** | (2006.01) |
| ***B08B 9/053*** | (2006.01) |
| *F28D 7/16* | (2006.01) |

(56) References Cited

U.S. PATENT DOCUMENTS 4,336,074 A * 6/1982 Dinkelacker ..... B08B 9/057 134/8
4,550,466 A * 11/1985 Schmitz ..... B08B 9/0552 15/104.061
4,556,102 A * 12/1985 Bochinski ..... F28G 1/12 134/8
4,569,097 A * 2/1986 Echols ..... B08B 9/055 15/104.061
5,086,833 A 2/1992 Ben-Dosa
5,473,787 A * 12/1995 Echols ..... B07B 1/50 15/104.061
6,272,713 B1 * 8/2001 Lotwin ..... B08B 9/0552 15/104.061
2004/0099406 A1 * 5/2004 Schildmann ..... B08B 9/055 165/95
2008/0263795 A1 * 10/2008 Chow ..... B08B 9/055 15/104.062
2010/0236757 A1 * 9/2010 Chou ..... B08B 9/055 165/95
2012/0012139 A1 1/2012 Soh et al.
2014/0299158 A1 * 10/2014 Cooper ..... B08B 9/0321 134/22.12
2015/0298180 A1 * 10/2015 Hochfellner ..... B08B 9/057 451/76

FOREIGN PATENT DOCUMENTS

GB 2467942 A * 8/2010 ..... B08B 9/0323
WO 2010/095110 A2 8/2010

* cited by examiner

METHOD OF CLEANING A HEAT EXCHANGER

FIELD OF THE INVENTION

The present invention relates to a method for cleaning a heat exchanger.

BACKGROUND OF THE INVENTION

Heat exchange systems are used in various industries for a myriad of applications. Common applications of the heat exchange systems include heating ventilation and air-conditioning (HVAC) installations. In such installations, fluid is circulated through the heat exchange system for heat exchange to occur at a bundle of tubes making up a portion of the heat exchange system. Heat exchange efficiency at the bundle of tubes requires debris and fouling deposits accumulated therewithin to be substantially removed. Taking the heat exchange system off-line for physical flushing is not only ineffective but also disallow use of the heat exchange system for the duration it remains off-line.

Current cleaning systems for use in conjunction with the heat exchange systems uses sponge balls transported by fluid to be fed and circulated in the heat exchange system. When the balls passage through the bundle of tubes during circulation in the heat exchange system, any debris or fouling deposits in the bundle of tubes are pushed out.

It is known in the art that some of such cleaning systems utilize sponge balls that are larger than the internal diameter of the tubes of the heat exchanger. The sponge balls are highly compressible such that when the balls squeeze into the tubes, they tend to expand back to their initial uncompressed state, thereby generating a frictional force along the inner surface of the tube as the balls move through. The sponge balls can thus only be transported singularly through the tube. It is this frictional force along the internal surface of the tubes that scrubs deposits and dirt off the surface. However, if the sponge ball encounters a large deposit, the force of the fluid may not be sufficient to push the sponge ball through and the sponge ball becomes stuck within the tube.

Sponge balls are designed to be used for heat exchanger tubes with smooth internal surfaces. For tubes with rifling grains, also known as enhanced tubes, the scrubbing action of the compressed sponge balls cannot reach the grooves of enhanced tubes; they can only clean the landings of the enhanced tubes. It is in these grooves where dirt accumulates and need cleaning most.

In addition, in heat exchangers with multiple horizontal tubes arranged in stacks, the sponge balls cannot be efficiently distributed to all the tubes in the stacks. The sponge balls are all of the same weight and will generally float or sink to the same portion of the stack. This leaves the other tubes in the stack with little sponge balls to for proper cleaning thereof.

Therefore, there is an apparent need for an improved method of cleaning a heat exchanger in order to address the foregoing problems.

SUMMARY OF THE INVENTION

The present invention provides a method for cleaning a heat exchanger. The heat exchanger comprises a plurality of tubes extending between a first header and a second header of the heat exchanger. The heat exchanger further comprises an insertion unit for introducing a plurality of projectiles into the heat exchanger. A first step of the method comprises pumping a fluid into the first header. A second step comprises inserting the plurality of projectiles into the fluid, such that the plurality of projectiles are distributed within the fluid. A third step comprises flowing the fluid and the plurality of projectiles through the plurality of tubes, such that the plurality of projectiles abrades at least one tube. A fourth step of the method comprises discharging the fluid and the plurality of projectiles out of the second header. In the method for cleaning the heat exchanger, among the plurality of projectiles, at least one projectile has a different specific gravity, relative to the fluid, from at least one of the remaining projectiles.

DETAILED DESCRIPTION OF THE EMBODIMENTS

Figure 1:
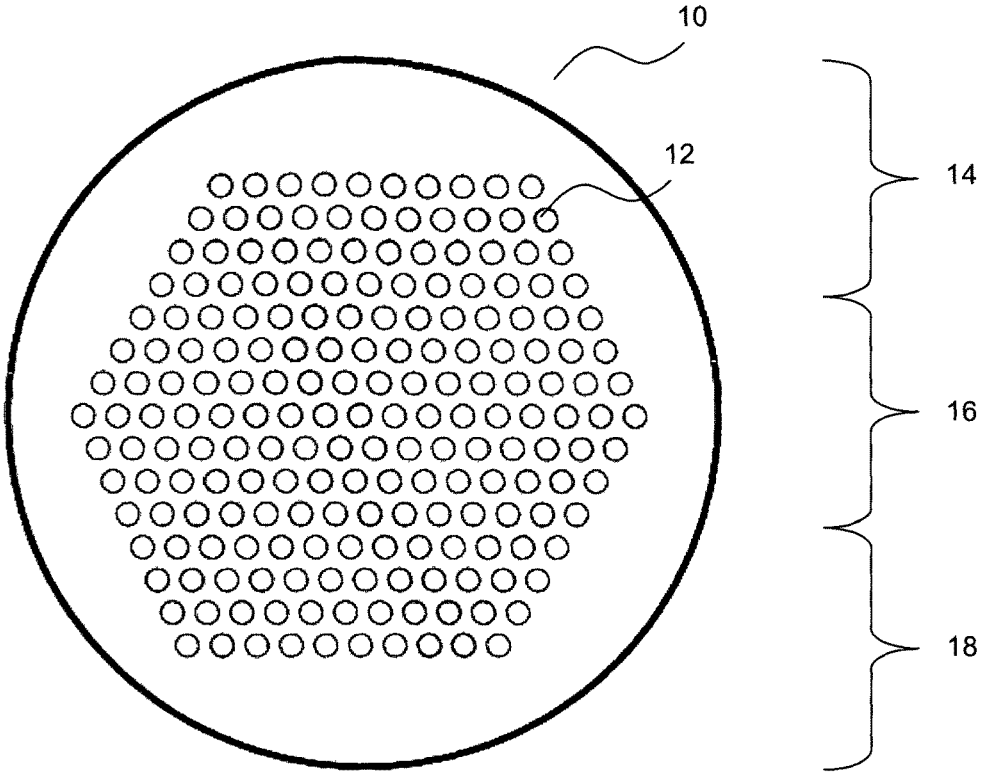
FIG. 1 to FIG. 9 shows multiple cross-sectional views of a heat exchanger with the plurality of tubes arranged in various configurations.
Figure 2:
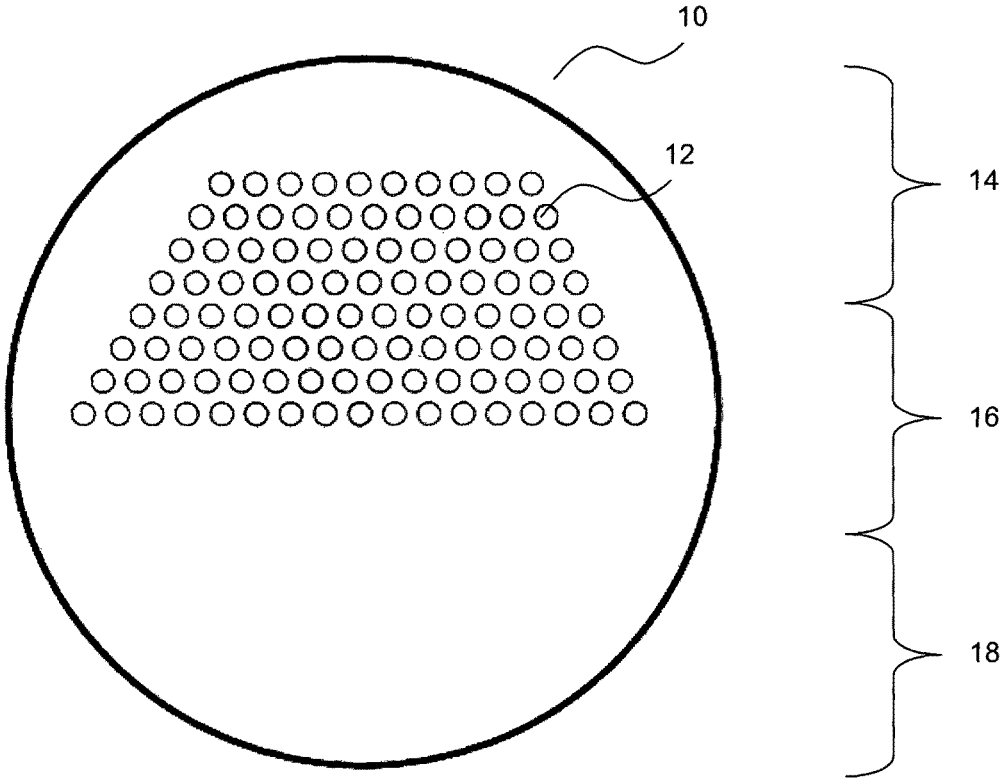
Figure 3:
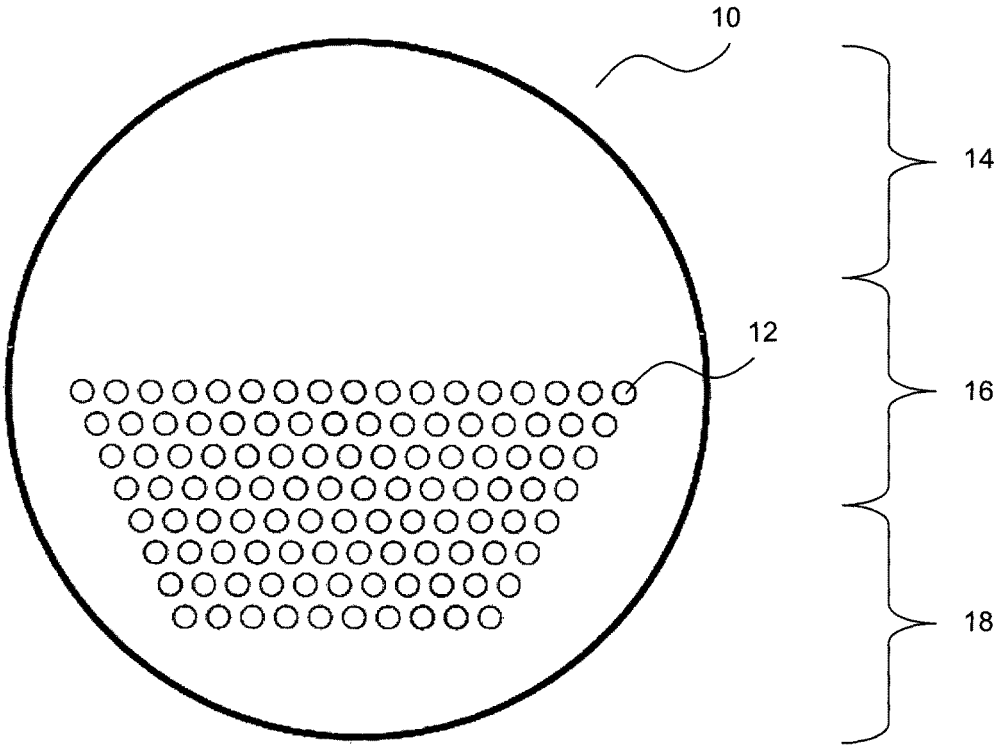
Figure 4:
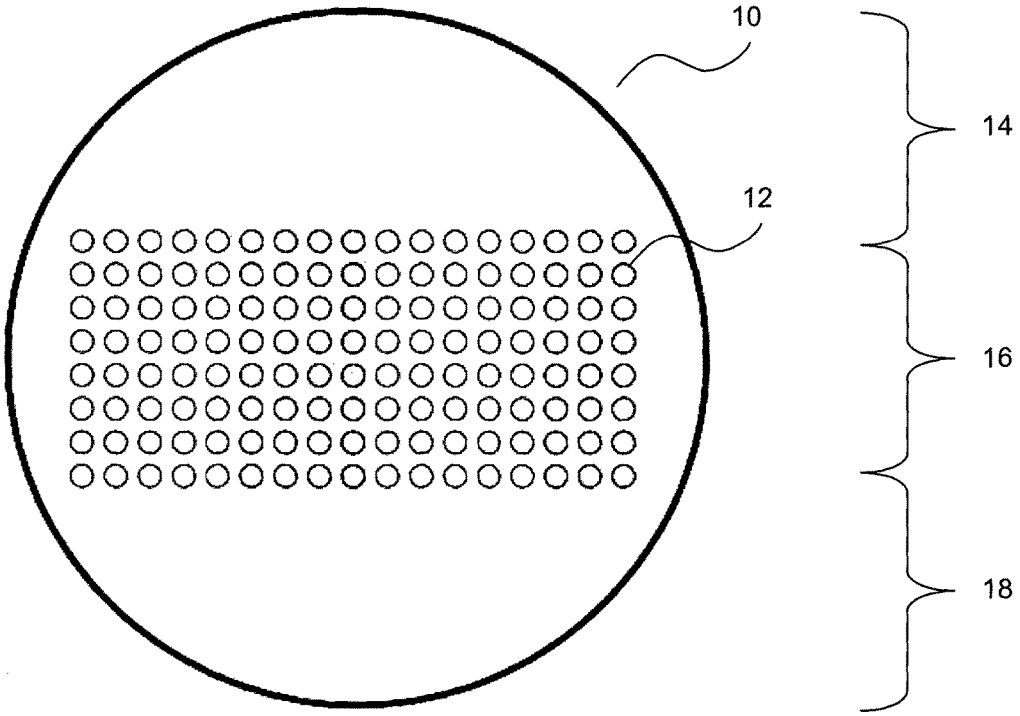
Figure 5:
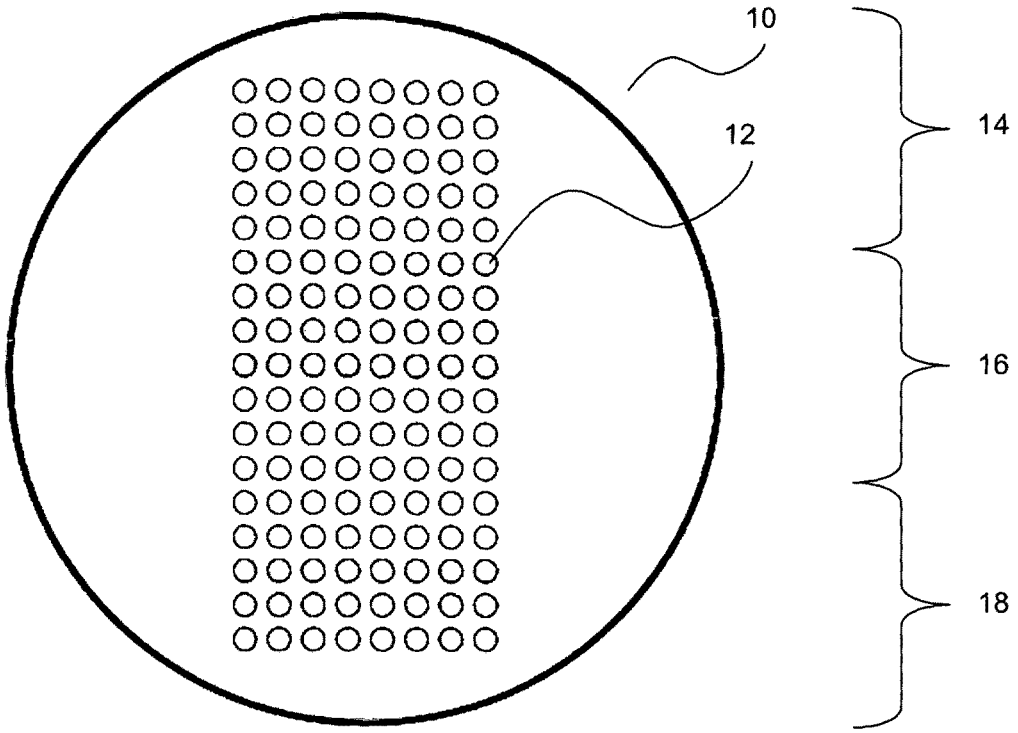
Figure 6:
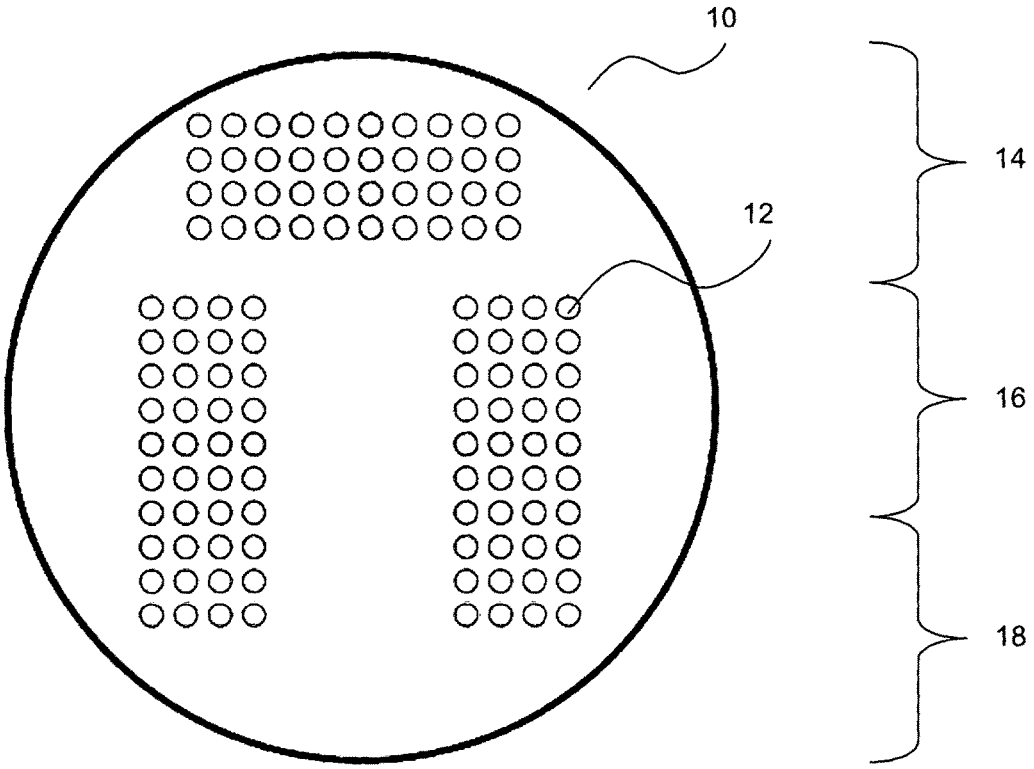
Figure 7:
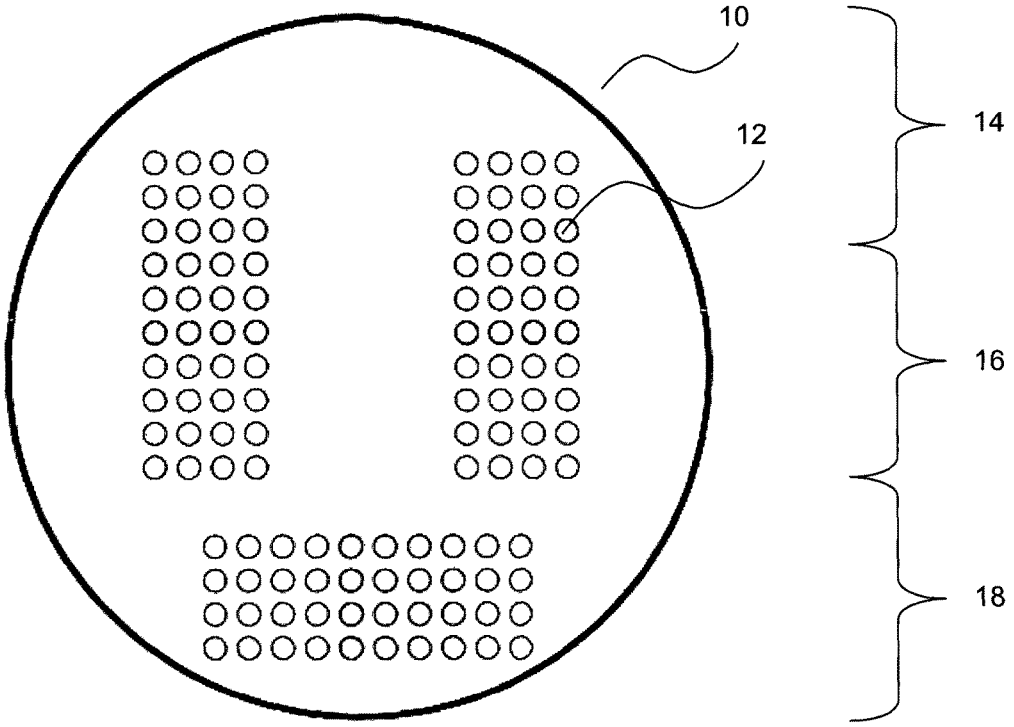
Figure 8:
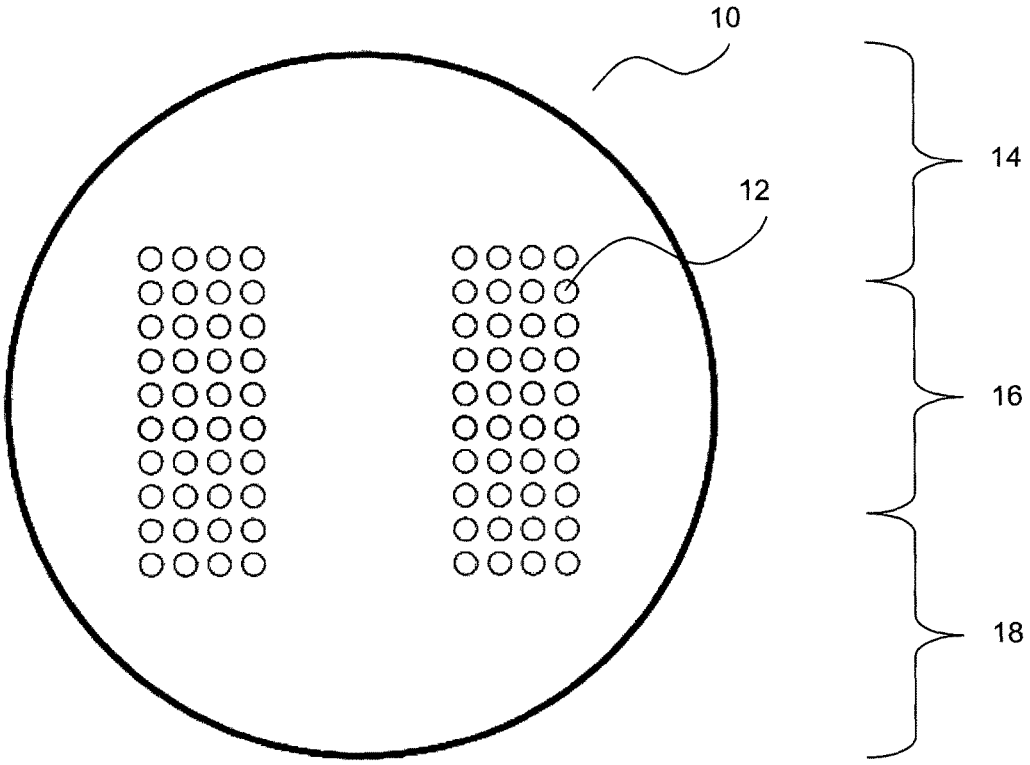
Figure 9:
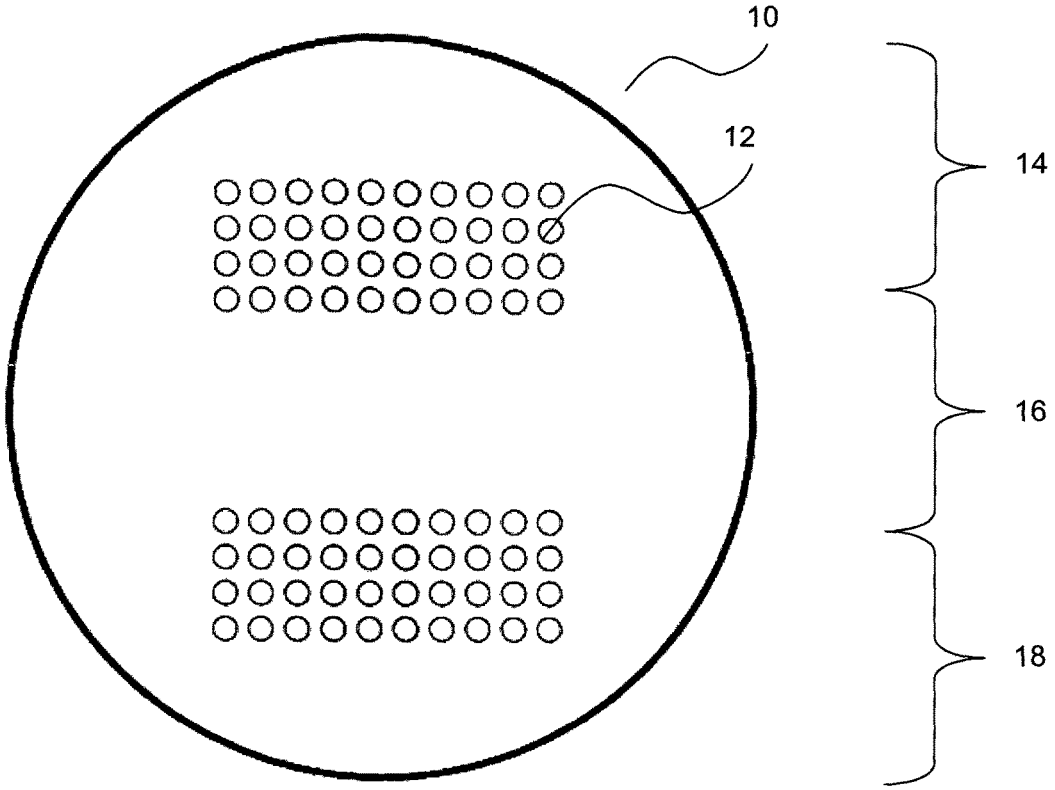

Reference will now be made in detail to an exemplary embodiment of the present invention. While the invention will be described in conjunction with the embodiment, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

For purposes of brevity and clarity, descriptions of an embodiment of the present invention are limited hereinafter to a method for cleaning a heat exchanger 10, in accordance with the drawings in FIG. 1 to FIG. 9. This however does not preclude embodiments of the invention where fundamental principles prevalent among the various embodiments of the invention such as operational, functional or performance characteristics are required.

In an exemplary embodiment of the present invention, a method for cleaning a heat exchanger 10 or heat exchange system is described hereafter. The heat exchanger 10 comprises a plurality of tubes 12. The plurality of tubes 12 is, for example, an evaporator or a condenser of heating, ventilation, and air-conditioning (HVAC) systems or the like heat-exchange systems. For such heat exchange systems, heat transfer occurs at one or more segments containing the plurality of tubes 12. The plurality of tubes 12 are typically clustered as a module with an intake at a first header of the heat exchanger 10, wherethrough a fluid is introduced, and an exhaust at a second header of the heat exchanger 10, wherefrom the fluid passaging through the plurality of tubes 12 is subsequently discharged.

There is a displacement pump for circulating the fluid, which may be in a liquid or gaseous state, or a combination thereof, through the heat exchange system, specifically through the plurality of tubes 12. The displacement pump is used to pump the fluid into the intake at the first header for passaging through the plurality of tubes 12. The method of cleaning the heat exchanger 10 may be used in conjunction with the operation of the heat exchanger 10, i.e. when the displacement pump is circulating the fluid through the plurality of tubes 12.

The heat exchange system comprises an insertion unit, having a plurality of projectiles 20 stored therein. The insertion unit functions to introduce or insert the plurality of projectiles 20 into the heat exchanger 10. In conjunction with the operation of the heat exchanger 10, the plurality of projectiles 20 is inserted into the fluid, such that the projectiles are distributed within the fluid. When the fluid is passaging through the plurality of tubes 12, the projectiles 20 flow together with the fluid through the tubes 12. As the flow progresses, the plurality of projectiles 20 abrade the inner surface of at least one tube 12, thereby encountering and removing particles along the inner surfaces of the tubes 12. The fluid, together with the plurality of projectiles 20, is discharged out the exhaust at the second header. Among the plurality of projectiles 20, at least one projectile 20 has a different specific gravity, relative to the fluid, from at least one of the remaining projectiles 20.

The specific gravity relative to the fluid is defined as the ratio of the density of the projectile 20 to the density of the fluid. For example, a projectile 20 with a higher density than that of the fluid will have a ratio of more than one; and a projectile 20 with a lower density than that of the fluid will have a ratio of less than one. In this embodiment, the plurality of tubes 12 are arranged horizontally such that the plurality of tubes 12 may be separated into three distinct portions top 12, middle 14, and bottom 16. As the fluid containing the projectiles 20 is pumped into the plurality, of tubes 12 via the intake at the first header, the projectiles 20 will distribute themselves among the top 14, middle 16, and bottom 18 portions of the plurality of tubes 12, depending on the specific gravity of each projectile 20. Projectiles 20 with a specific gravity equal to unity will stay buoyant within the fluid, such that the projectiles 20 suspend in the fluid around a middle portion 16 of the plurality of tubes 12. Projectiles 20 with a specific gravity of less than unity will float in the fluid around a top portion 14 of the plurality of tubes 12. Projectiles 20 with a specific gravity of more than unity will sink in the fluid around a bottom portion 18 of the plurality of tubes 12.

The advantage of having projectiles 20 with different specific gravities is that with such control of the specific gravities, the user is able to determine what portion of the projectiles 20 goes to which portion of the plurality of tubes 12. For example, in some heat exchangers 10, the plurality of tubes 12 may not be evenly distributed in the top 14, middle 16, and bottom 18 portions. Some heat exchangers may have more tubes 12 in the top portion 14 and lesser tubes 12 in the bottom portion 18. Some examples of such arrangements and configurations can be seen in FIG. 1 to FIG. 9. Hence, by way of example and not limitation, by having more projectiles 20 with lower specific gravities and lesser projectiles 20 with higher specific gravities, there will be more projectiles 20 going to the top portion 14 of the plurality of tubes 12 and lesser projectiles 20 going to the bottom portion 18 of the plurality of tubes 12. This leads to a more even distribution of the plurality of projectiles 20 within the plurality of tubes 12. The user thus has the advantage of controlling the portion of projectiles 20 going to whichever portion of the plurality of tubes 12. In contrast, if projectiles 20 of the same specific gravity are used, the projectiles 20 will float or sink to the portion of the plurality of tubes 12 where their buoyancy allows them to be. In some cases, some of the tubes 12 will not receive any projectiles 20, because their buoyancy does not allow them to reach those tubes 12, and those tubes 12 will not be cleaned as there will not be any projectiles 20 passaging therethrough.

The projectiles 20 may also be known as cleaning balls or elastomeric balls. The projectiles 20 may also be made of other types of resilient materials. Unlike large sponge balls used in prior art systems, the elastomeric projectiles are highly resilient and not as compressible as the sponge balls. The elastomeric projectiles are not designed for compression while they squeeze through the tubes. Instead, the elastomeric projectiles are designed to be smaller than the internal diameter of the tubes for bouncing inside the tubes. The resilient material of the elastomeric projectiles allows them to sustain continued wear and tear as they bounce and move through the tubes for cleaning thereof As the plurality of projectiles 20 are introduced into the first header, the projectiles 20 travel through the plurality of tubes 12 for cleaning thereof. The projectiles 20 are thus dimensioned to be smaller than the internal diameter of the plurality of tubes 12, i.e. the largest width of each projectile 20 is smaller than the largest internal diameter of each tube 12. For example, each projectile 20 may have a largest width of 11 to 12 millimeters, while the largest internal diameter of each tube 12 is 15 to 16 millimeters. Preferably, the ratio between the largest width of the projectile 20 and the largest internal diameter of the tube 12 is between 0.75 and 0.85. The tolerance of 3 to 5 millimeters between the projectiles 20 and the inner surface of the tube 12 allows the projectiles 20 to have some degree of freedom of movement within the tube 12. Thus, the projectiles 20 can bounce or ricochet off the inner surface of the plurality of tubes 12 while passaging therethrough for dislodging of debris and deposit therefrom and cleaning thereof. In addition, by having the projectiles 20 smaller than the internal diameter of the tube 12, the projectiles 20 will not be trapped while being carried therethrough, as in the case of a prior art system in which the projectile 20 is larger than the internal diameter of the tube 12 and is being forced through the tube 12 to scrape deposits off the inner surface thereof.

Subsequent to the passaging of the plurality of projectiles 20 through the plurality of tubes 12 and the cleaning thereof, the projectiles 20 have to be retrieved for storage and/or future usage. Preferably, the heat exchanger 10 comprises a configuration means, as commonly known in the art, which selectively impedes the passage of the projectiles 20 through the tubes 12. By way of example and not limitation, the heat exchanger 10 may comprise a flow diverting system coupled to the exhaust and a trap disposed proximal thereto. The flow diverting system and the trap is configurable for collecting the projectiles 20 that are discharged out of the tubes 12, thus preventing further transport of the projectiles 20 through the rest of the heat exchange system 10. Alternatively, the flow diverting system and trap may be configured such that the projectiles 20 are not collected thereby, but instead are transported through the rest of the heat exchanger 10 and back to the intake for another cycle of cleaning of the tubes 12. Other configuration means known to the person having ordinary skill in the art may also be implemented in the heat exchanger 10.

Figure 10:
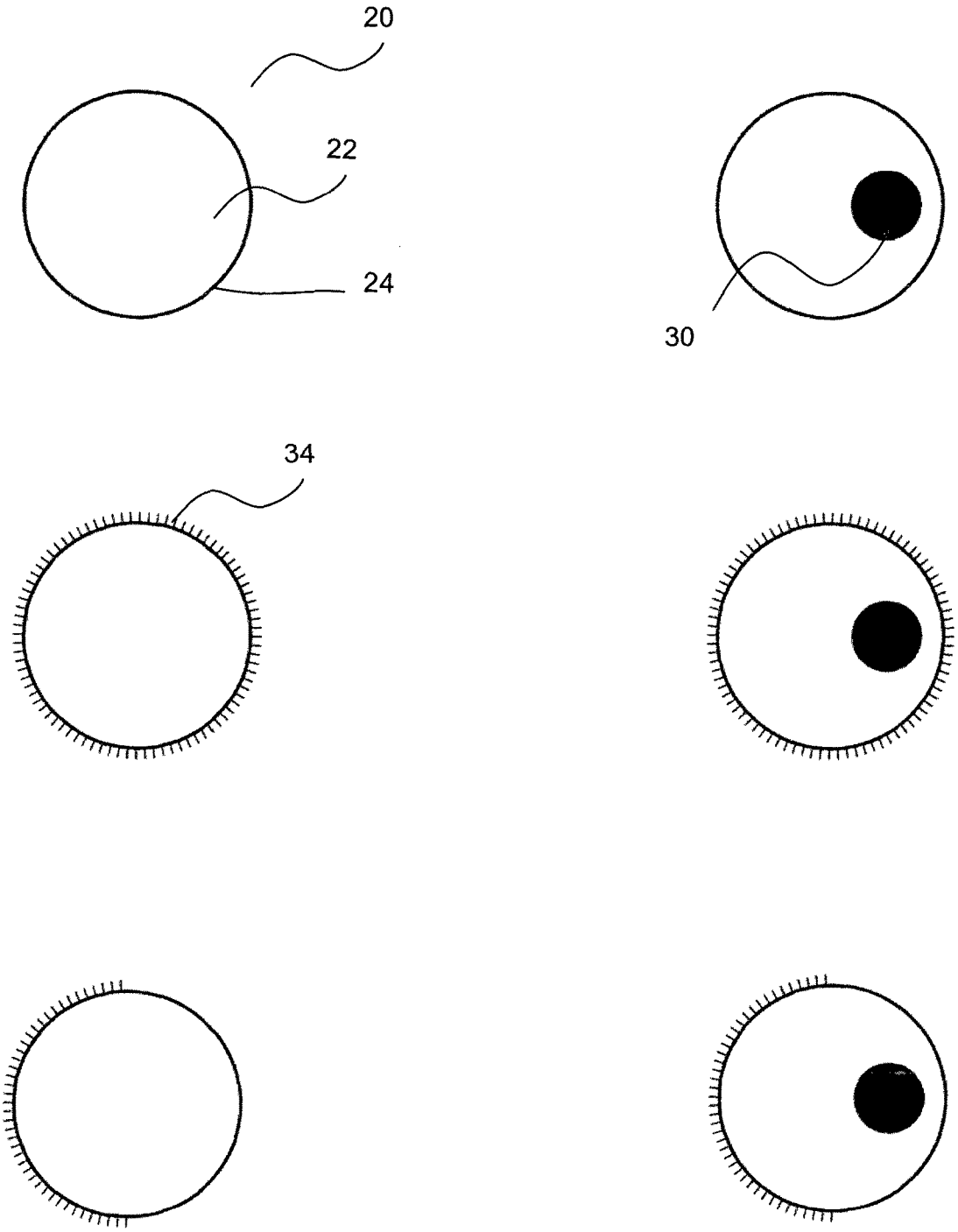
FIG. 10 to FIG. 12 shows different variations of the plurality of projectiles.
Figure 11:
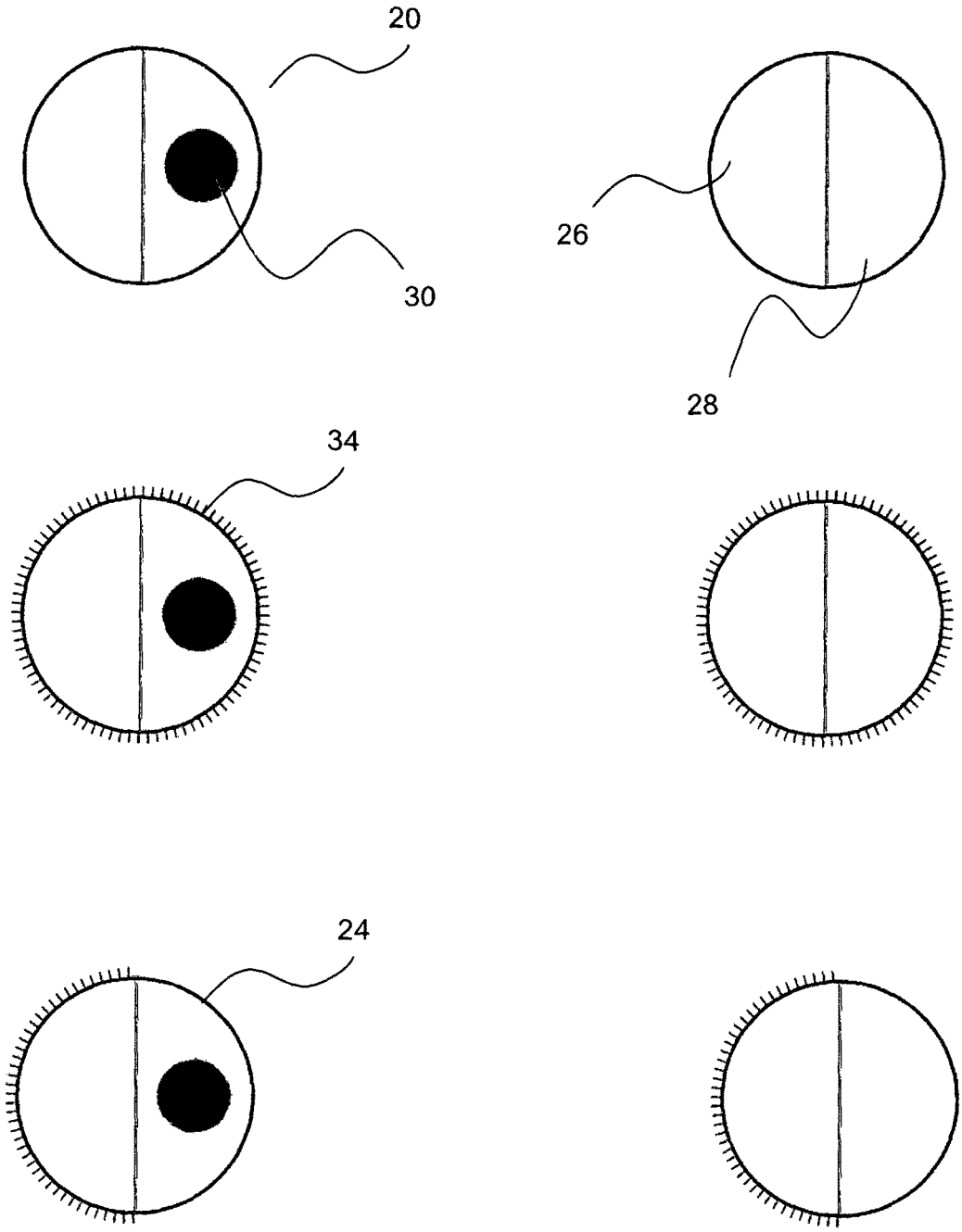
Figure 12:
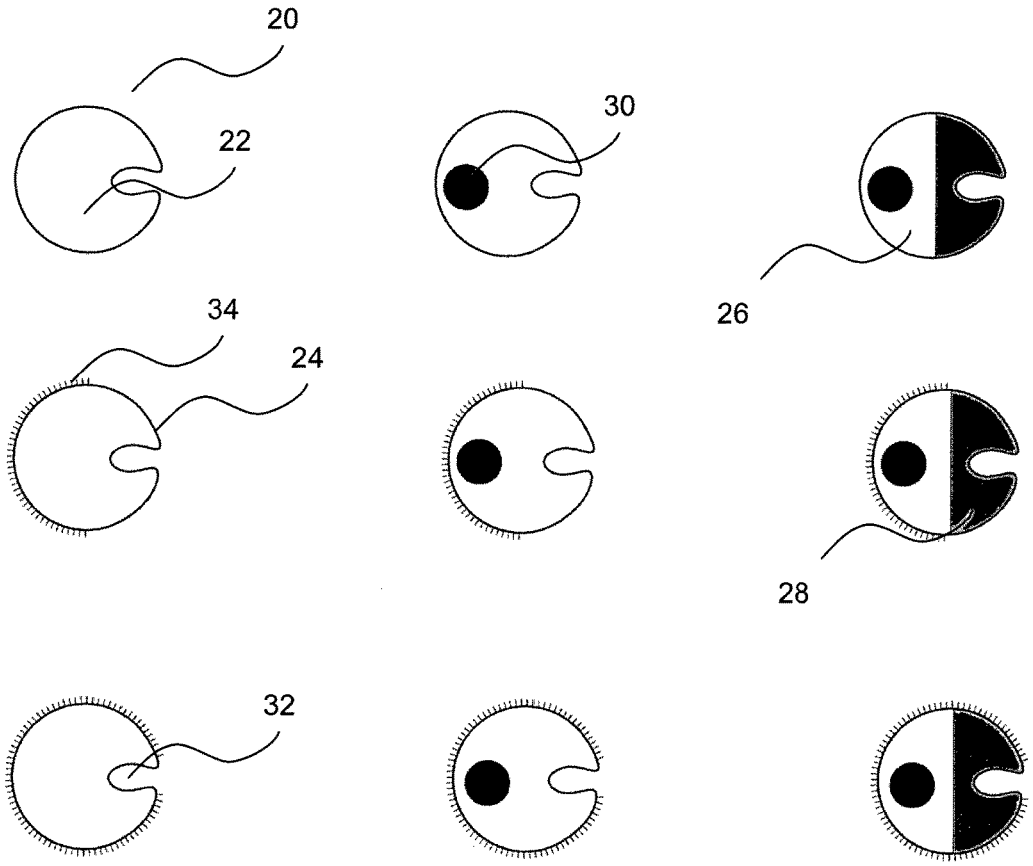

With reference to FIG. 10 to FIG. 12, each of the projectiles 20 has a centre of mass that may be at any location or point within the body 22 of the projectile 20. Using an example of a single, uniform, spherical projectile 20, its centre of mass is positioned at its geometric centre. The position of the centre of mass in the projectile 20, i.e. the offset of the centre of mass away from the geometric centre, affects the lateral bouncing of the projectile 20 when passaging through a tube 12. The greater the offset is towards the surface 24 of the projectile 20, the greater will be the lateral bouncing of the projectile 20. This leads to increased randomness of the bouncing of the projectiles 20 when passaging through the tubes 12.

The offset and the specific gravity of each projectile 20 may be varied through different means. The following describes some non-limiting examples of such means.

Each projectile 20 has a geometric centre within its body 22 and an outer surface 24, and the centre of mass may be positioned anywhere within the body 22, between the geometric centre and the outer surface 24, inclusive. A projectile 20 with a uniform material composition will have the centre of mass at the geometric centre, while a projectile 20 with non-uniform material composition, such as through a combination of two structural portions 26 and 28 with different material compositions, will have the centre of mass positioned away from the geometric centre.

The projectile 20 may include a hollow portion 30 within the projectile 20, thereby shifting the centre of mass away from the hollow portion 30. Alternatively or additionally, a ball bearing made of metal and/or other material, may be placed in the hollow portion 30. A recess 32 may also be created on the surface 24 of the projectile 20. The recess 32 may be shallow through a small portion under the surface 24, or the recess 32 may be deep through till near or through the opposite side of the surface 24. The recess 32 may be a straight or tapered bore to provide greater variation to the location of the centre of mass. The projectile 20 may also comprise of multiple structural portions, for example 26 and 28, combined together.

Each portion may have a material that is different from the other portions. The non-uniformity of the material composite of the projectile 20 provides varying degrees of the offset of the centre of mass from the geometric centre. Other methods of varying the position of the centre of mass, known to the skilled person, are also possible.

Preferably, at least one projectile 20 comprises bristles 34 extending outwards from the surface 24 of the projectile 20. The bristles 34 may be disposed all around the surface 24 of the projectile 20, or only on a portion of the surface 24. The bristles 34 advantageously assist in the abrading and scraping of deposits from the inner surface of the plurality of tubes 12 when the projectiles 20 are passaging therethrough. Moreover, the inner surface of the tubes 12 may not be entirely smooth and may comprise a rifling grain, such as enhanced tubes. The bristles 34 thus assist in removing deposits from the grooves of the inner surface of the tubes 12. Alternatively or additionally, where the projectile has its surface partially covered with the bristles, the bristled portion will scrub against the grooves of the enhanced tubes, while the non-bristled portion will scrub against the landings of the enhanced tubes, thereby providing a more uniform scrubbing action against the insides of the enhanced tubes.

In cleaning the heat exchanger 10, the fluid is pumped through the plurality of tubes 12, with the plurality of projectiles 20 transported within the fluid. Preferably, the rate of flow of the fluid through the tubes 12 is controllable by a system and/or device implemented in the heat exchange system. By controlling the rate of flow of the fluid through the tubes 12, the speed of the projectiles 20 through the tubes 12 can thus be controlled. For example, a projectile 20 travelling at a higher speed will be subjected to greater bounce and higher frictional forces. Therefore, the projectile 20 will bounce more within the internals of the tube 12, and every contact with the inner surface of the tube 12 has a higher frictional force thereon. The higher frictional force improves the abrading of the inner surface of the tube 12 and thus provides for more efficient cleaning of the tube 12.

In a foregoing manner, a method of cleaning a heat exchanger 10 is described according to an exemplary embodiment of the invention. Although only one embodiment of the invention is disclosed in this document, it will be apparent to one skilled in the art in view of this disclosure that numerous changes and/or modifications can be made to the disclosed embodiment without departing from the scope and spirit of the invention.

The invention claimed is:

1. A method for cleaning a heat exchanger having a plurality of tubes extending between a first header and a second header, and having an insertion unit for introducing a plurality of projectiles into the heat exchanger, the method comprising:

pumping a fluid into the first header;

inserting the plurality of projectiles into the fluid, such that the plurality of projectiles are distributed within the fluid;

flowing the fluid and the plurality of projectiles through the plurality of tubes, such that the plurality of projectiles abrade the plurality of tubes; and discharging the fluid and the plurality of projectiles out of the second header;

wherein a first specific gravity of a first subset of the plurality of projectiles relative to the fluid is equal to unity, such that the first subset of the plurality of projectiles suspend in the fluid around a middle portion of the plurality of tubes;

wherein a second specific gravity of a second subset of the plurality of projectiles relative to the fluid is less than unity, such that the second subset of the plurality of projectiles float in the fluid around a top portion of the plurality of tubes;

wherein a third specific gravity of a third subset of the plurality of projectiles relative to the fluid is greater than unity, such that the third subset of the plurality of projectiles sink in the fluid around a bottom portion of the plurality of tubes;

wherein each of the plurality of projectiles has a geometric center and a center of mass that is positioned away from the geometric center;

wherein each of the plurality of projectiles has an outer surface and a recess formed in the outer surface; and wherein the recess formed in the outer surface of each of the plurality of projectiles is located opposite to the center of mass of the respective projectile and does not pass completely through the respective projectile from one side of the projectile to an opposing side of the projectile.

2. The method as in claim 1, wherein the center of mass of each of the plurality of projectiles is proximate to an outer surface of the respective projectile.

3. The method as in claim 1, wherein each of the plurality of projectiles comprises bristles extending outwards.

4. The method as in claim 1, wherein the largest width of each projectile is smaller than the largest internal diameter of each tube.

5. The method as in claim 4, wherein the ratio of the largest width to the largest internal diameter is between 0.75 and 0.85.

6. The method as in claim 1, wherein each of the plurality of projectiles comprises at least two structural portions combined together.

7. The method as in claim 6, wherein at least one structural portion comprises a material that is different from the remaining structural portions.

8. The method as in claim 1, wherein each of the plurality of projectiles is elastomeric.

* * * * *